US008928445B2

(12) United States Patent
Mori et al.

(10) Patent No.: US 8,928,445 B2
(45) Date of Patent: Jan. 6, 2015

(54) ELECTROMAGNETIC PIPE EXPANDING INDUCTOR AND METHOD FOR MANUFACTURING THE SAME

(75) Inventors: Mitsutoshi Mori, Kobe (JP); Hiroaki Hosoi, Kobe (JP); Hidetaka Kanahashi, Kobe (JP); Yoshihaya Imamura, Fujisawa (JP)

(73) Assignee: Kobe Steel, Ltd., Hyogo (JP)

( * ) Notice: Subject to any disclaimer, the term of this patent is extended or adjusted under 35 U.S.C. 154(b) by 872 days.

(21) Appl. No.: 12/591,780

(22) Filed: Dec. 1, 2009

(65) Prior Publication Data

US 2010/0134227 A1 Jun. 3, 2010

(30) Foreign Application Priority Data

Dec. 3, 2008 (JP) ..... 2008-309085
Mar. 11, 2009 (JP) ..... 2009-058793

(51) Int. Cl.

| | |
|---|---|
| ***H01F 27/02*** | (2006.01) |
| ***H01F 1/00*** | (2006.01) |
| ***H01F 27/32*** | (2006.01) |
| ***B21D 26/14*** | (2006.01) |
| ***H01F 41/12*** | (2006.01) |
| *H01F 7/20* | (2006.01) |
| *H01F 41/06* | (2006.01) |

(52) U.S. Cl.

CPC ..... *H01F 27/327* (2013.01); *B21D 26/14* (2013.01); *H01F 27/323* (2013.01); *H01F 41/127* (2013.01); *H01F 7/202* (2013.01); *H01F 27/322* (2013.01); *H01F 41/0687* (2013.01); *H01F 41/122* (2013.01)

USPC ..... 336/83; 336/82; 336/90; 335/216

(58) Field of Classification Search

USPC ..... 336/82, 83, 90; 335/216

See application file for complete search history.

(56) References Cited

U.S. PATENT DOCUMENTS 3,414,698 A * 12/1968 Bedford et al. ..... 219/630
2006/0132272 A1* 6/2006 Kitahara et al. ..... 336/192

FOREIGN PATENT DOCUMENTS

| | | |
|---|---|---|
| JP | 55-145309 A | 11/1980 |
| JP | 6-238356 | 2/1993 |
| JP | 2004-40044 | 7/2002 |
| JP | 2004-351455 | 5/2003 |

OTHER PUBLICATIONS

Office Action from Japanese Patent Office for Japanese Patent Application No. 2009-273709, mailed Dec. 11, 2012.

* cited by examiner

*Primary Examiner* — Elvin G Enad
*Assistant Examiner* — Ronald Hinson
(74) *Attorney, Agent, or Firm* — Studebaker & Brackett PC

(57) ABSTRACT

Provided is an electromagnetic pipe expanding inductor in which the formation of voids during resin impregnation is suppressed, and electromagnetic reaction forces acting on the conductor periphery and on the interface between the shaft portion and the center-side fiber layer is diminished, and thereby durability is improved and the life of the inductor is prolonged. A glass cloth tape (3) capable of being impregnated with resin is wound around the peripheral surface of a shaft portion of a bobbin (2) to a predetermined thickness, further, a conductor strand (4) coated with a glass cloth tape (6) is wound spirally in the axial direction of the bobbin (2) to form a coil. Further, a glass cloth (7) is wound around the outside of the glass cloth tape (6) to a predetermined thickness and thereafter the glass cloth tapes (3, 6) and the glass cloth (7) are impregnated with resin to unite them. A center-side resin-impregnated layer formed by the glass cloth tape 3 impregnated with resin is lower in the modulus of longitudinal elasticity than the shaft portion. Given that the inductor radius is r, the thickness, t, of the center-side resin-impregnated layer is 0.025r to 0.25r.

6 Claims, 5 Drawing Sheets

PRIOR ART

ELECTROMAGNETIC PIPE EXPANDING INDUCTOR AND METHOD FOR MANUFACTURING THE SAME

BACKGROUND OF THE INVENTION

1. Field of the Invention

The present invention relates to an electromagnetic pipe expanding inductor to be used for expanding a metallic pipe or the like which is an electric conductor by utilizing an electromagnetic force, as well as a method for manufacturing the same.

2. Description of the Related Art

According to the electromagnetic pipe expanding technique, an electric charge stored at a high voltage is discharged in an instant to an electromagnetic forming inductor to form a strong magnetic field around the inductor in an extremely short time and a workpiece is disposed within the strong magnetic field, thereby causing an electromagnetic reaction force to be created between the workpiece and a forming coil to expand the workpiece (Patent Literature 1).

The electromagnetic pipe expanding technique permits plastic working of electric conductors (e.g., Al, Cu, non-magnetic stainless steel, Ti) by utilizing an electromagnetic force and therefore can handle various shapes of workpieces, including pipe-like and plate-like workpieces. Accordingly, studies are being made about application of this technique to various fields.

As an electromagnetic pipe expanding inductor used in the electromagnetic pipe expanding technique there is known, for example, one disclosed in Patent Literature 2 or 3. FIG. 3 is a sectional view showing a conventional electromagnetic forming inductor disclosed in Patent Literatures 1 and 2. FIG. 3 illustrates a half portion from a central axis (a dot-dash line) of an electromagnetic pipe expanding coil to one peripheral surface.

As shown in FIG. 3, an electromagnetic pipe expanding inductor 101 has a bobbin 2 constituted like a shaft by insulating resin. A hollow conductor strand 4 of a rectangular section coated with a glass cloth tape 6 is wound spirally around the peripheral surface of the bobbin 2 as a center shaft to form a coil. A hollow portion 5 formed centrally of the conductor strand 4 functions as a refrigerant flowing path to cool the conductor strand 4. The conductor strand 4 is wound in such a manner that confronting surfaces of adjacent conductor strand 4 are parallel to each other. Further, glass cloth 7 is wound around the outside of the coil so as to have a predetermined thickness. Insulating resin 8 is impregnated into the glass cloth tape 6, glass cloth 7 and voids formed between constituents, thereby fixing the insulating layer and the conductor. The outer periphery of the glass cloth 7 is cut after the impregnation of the resin 8 so that the electromagnetic pipe expanding inductor 101 has a predetermined outside diameter.

Related Art Literatures

Patent Literature 1: Japanese Patent Laid-Open Publication No. 2004-351455

Patent Literature 2: Japanese Patent Laid-Open Publication No. 2004-40044

Patent Literature 3: Japanese Patent Laid-Open Publication No. Hei 06 (1994)-238356

However, the above conventional technique involves the following problems. In the electromagnetic pipe expanding inductor 101 shown in FIG. 3, the resin 8 impregnates along the fibers of the glass cloth and does not penetrate the resin itself of the bobbin 2. Consequently, a boundary portion (portion B in FIG. 3) between adjacent glass cloth tape 6 which covers the conductor, the boundary portion being positioned just above the bobbin, is apt to become deficient in impregnation of the resin, with the result that a void is apt to occur. On the other hand, when using the electromagnetic pipe expanding inductor 101, a large current is passed through the coil, causing vibration of the conductor strand 4. Therefore, if a void is in the interior of the electromagnetic pipe expanding inductor 101, the void is apt to become a source of developing a crack. As the electromagnetic pipe expanding inductor 101 is used repeatedly, the crack thus developed becomes larger and is likely to eventually cause deformation and breakage of the electromagnetic pipe expanding inductor 101. Thus, the life of the electromagnetic pipe expanding inductor having voids in the interior thereof becomes shorter.

FIG. 4 is a schematic diagram showing an electromagnetic force which acts on a conductor during an electromagnetic pipe expanding work. A conductor 23 coated with resin 22 is wound around the peripheral surface of a shaft portion 21 to constitute an electromagnetic pipe expanding inductor and a metallic to-be-expanded pipe 20 is disposed outside the inductor. In the pipe expanding work which utilizes an electromagnetic force, when an instantaneous electromagnetic force is exerted on the to-be-expanded pipe, simultaneously the coil conductor 23 is subjected to an electromagnetic reaction force 24 in a radial direction toward the neutral axis of the coil and is further subjected to an electromagnetic reaction force in the direction of the neutral axis (a dot-dash line) in the vicinity of an end of the to-be-expanded pipe, due to an interaction between the electric current flowing through the conductor 23 and a flux density, thus giving rise to the problem that the inductor itself or the conductor is deformed, thereby causing breakage. In FIG. 4, Fr represents an electromagnetic force acting in the radial direction, while Fz represents an electromagnetic force acting in the axial direction.

Further, when damage is accumulated as a result of repetition of the instantaneous electromagnetic reaction force and the aforesaid deformation is conspicuous and when peeling proceeds into mutual contact of adjacent conductor 23 due to a shear force 25 acting on the interface between the shaft portion 21 and the conductor 23 coated with the impregnating resin, there occurs sparking due to conduction and breakage. In view of this point the impregnating resin 22 having an insulating property is disposed between coil conductor. However, under the instantaneous electromagnetic reaction force, there is a fear of pressure breakage or peeling to breakage even of the impregnating resin 22.

SUMMARY OF THE INVENTION

The present invention has been accomplished in view of the above-mentioned problems and it is an object of the invention to provide an electromagnetic pipe expanding inductor in which the formation of voids during resin impregnation is suppressed, and electromagnetic reaction forces acting on the conductor periphery and on the interface between the shaft portion and the center-side fiber layer is diminished, and thereby durability is improved and the life of the inductor is prolonged.

The electromagnetic pipe expanding inductor according to the present invention comprises a shaft portion, a center-side resin-impregnated layer different in strength characteristics from the shaft portion, the center-side resin-impregnated layer being formed by impregnating insulating resin into a resin-impregnatable fiber layer coated on a periphery of the shaft portion and then hardening the insulating resin, a coil formed by winding a conductor around a peripheral surface of the center-side resin-impregnated layer, the conductor being coated with a resin-impregnatable fiber layer impregnated with insulating resin, the insulating resin being hardened after the impregnation, and an outer resin-impregnated layer formed by impregnating a resin-impregnatable fiber layer coated on an outer periphery of the coil with insulating resin and hardening the insulating resin. In this case, the strength characteristics are mainly a modulus of longitudinal elasticity. However, a difference in the modulus of longitudinal elasticity would result in a difference also in tensile strength and anisotropy as material characteristic values.

In this case, the resin-impregnatable fiber layers may each be constituted by a glass cloth tape. It is preferable that the resin-impregnatable fiber layer which constitutes the center-side resin-impregnated layer be constituted by the glass cloth tape wound once or more around the shaft portion, and that the ratio t/r of the thickness, t, of the center-side resin-impregnated layer to the radius, r, of the whole of the inductor be in the range from 0.025 to 0.25. By the description that the center-side resin-impregnated layer is different in strength characteristics from the shaft portion, it is meant that, for example, the center-side resin-impregnated layer is lower in the modulus of longitudinal elasticity than the shaft portion.

It is preferable that the radius of the electromagnetic pipe expanding inductor be 35 mm or smaller, and that when the modulus of longitudinal elasticity of the shaft portion and that of the center-side resin-impregnated layer are assumed to be E1 and E2, respectively, the shaft portion be formed of a material having an E1/E2 ratio of 1.9 or more.

A method for manufacturing an electromagnetic pipe expanding inductor according to the present invention comprises the steps of: coating a peripheral surface of a shaft portion with a resin-impregnatable fiber layer serving as a center-side resin-impregnated layer; winding a conductor coated with a resin-impregnatable fiber layer around a peripheral surface of the fiber layer serving as the center-side resin-impregnated layer to form a coil; coating an outer periphery of the coil with a resin-impregnatable fiber layer serving as an outer resin-impregnated layer; impregnating the resin-impregnatable fiber layers with insulating resin; and hardening the insulating resin, wherein the step of coating the peripheral surface of the shaft portion with the fiber layer serving as the center-side resin-impregnated layer comprises the steps of: winding a glass cloth tape once or more around the shaft portion in a state in which the glass cloth tape is lapped over a half or more of its width; or winding a glass cloth tape of a width large enough to cover a portion to be covered, once around the shaft portion; or covering the shaft portion with a glass cloth tube having stretchability.

According to the present invention, the center-side resin-impregnated layer different in strength characteristics (e.g., modulus of longitudinal elasticity) from the shaft portion is disposed between the shaft portion and the coil, whereby it is possible to diminish electromagnetic reaction forces acting on the periphery of the coil conductor and also on the interface between the shaft portion and the center-side resin-impregnated layer, and thereby diminish a shear force developed at the layer interface and improve the durability remarkably. In the present invention, moreover, since the center-side resin-impregnatable resin layer is disposed between the resin-impregnatable fiber layer which coats the conductor and the shaft portion, the resin is sufficiently impregnated into the interface between the fiber layers such as the periphery of conductor at the time of resin impregnation, and the formation of voids each acting as a starting point of a crack is suppressed. As a result, it is possible to afford an electromagnetic pipe expanding inductor of a long life.

DETAILED DESCRIPTION OF A PREFERRED EMBODIMENT

Figure 1:
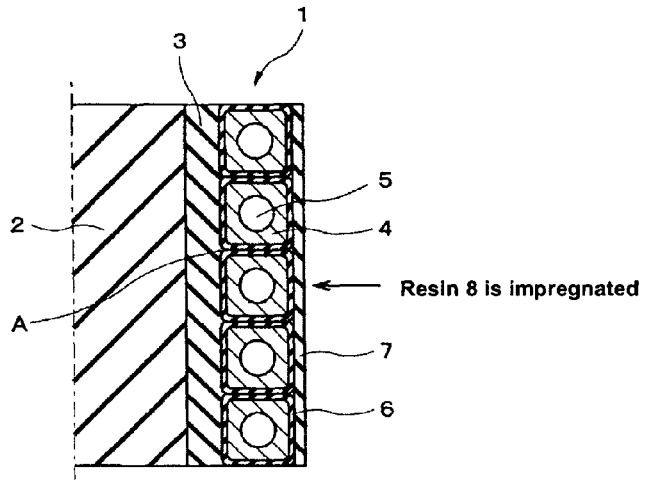
FIG. 1 is a sectional view showing an electromagnetic pipe expanding inductor according to an embodiment of the present invention.

An embodiment of the present invention will be described below concretely with reference to the accompanying drawings. FIG. 1 is a sectional view showing an electromagnetic pipe expanding inductor according to an embodiment of the present invention. In FIG. 1, one half of the electromagnetic pipe expanding inductor is shown in a section taken along the central axis (indicated by a dot-dash line) of the inductor.

As shown in FIG. 1, the electromagnetic pipe expanding inductor, indicated by 1, of this embodiment has a columnar bobbin 2 which constitutes a shaft portion. The bobbin 2 is formed of insulating resin for example. The bobbin 2 may have a flange portion or the like for fixing to the exterior, in addition to the shaft portion shown in FIG. 1. Although the bobbin is described herein as being shaft-like, it may be formed in a tubular shape for example.

Around the peripheral surface of the shaft portion of the bobbin 2 is wound a glass cloth tape 3 to a predetermined thickness, the glass cloth tape 3 being a fiber layer serving as a center-side resin-impregnated layer. The glass cloth tape 3 is formed by weaving glass fibers in the shape of a tape and has resin-impregnatability for insulating resin. In this embodiment, glass cloth 7 and glass cloth tape 6 both to be described later, as well as the glass cloth tape 3, possess resin-impregnatability.

A conductor strand 4 is in a tubular shape having a rectangular section and centrally formed with a circular hollow portion 5 for the flow of refrigerant therethrough. An outer surface of the conductor strand 4 is coated with a glass cloth tape 6 which is a resin-impregnatable fiber layer. The glass cloth tape 6 is also impregnated with insulating resin, the resin being hardened after the impregnation. The hollow conductor strand 4 is wound spirally on the glass cloth tape 3 wound around the peripheral surface of the bobbin 2 as a central shaft, to constitute a coil. In this case, the conductor strand 4 is wound closely in such a manner that confronting surfaces of adjacent strand conductor 4 become parallel to each other and that adjacent portions of glass cloth tape 6 come into contact with each other. The conductor strand 4 is fabricated using, for example, copper or copper alloy and is supplied with electric power by being connected to a power supply unit (not shown). Liquid or gaseous refrigerant is supplied in a circulative manner from a refrigerant supply unit to the interior of the hollow portion 5 of the conductor strand 4 to cool the heat generated during use as coil.

A glass cloth 7 which is a fiber layer serving as an outer resin-impregnated layer is wound on the outer peripheral surface of the coil to a predetermined thickness. The glass cloth 7 is sheet-like, but may be, for example, tape-like. The glass cloth tape 3, glass cloth tape 6 and glass cloth 7 are all resin-impregnatable fiber layers, which are impregnated with insulating resin from the peripheral surface side of the inductor, the resin being hardened after the impregnation. The insulating resin is impregnated between the fiber layers and hardened. As a result of impregnation of insulating resin into the glass cloth tape 3 and hardening thereof, the glass cloth tape 3 forms a center-side resin-impregnated layer. As a result of impregnation of insulating resin into the glass cloth 7 and hardening thereof, the glass cloth 7 forms an outer resin-impregnated layer. As the insulating resin, an epoxy resin having thermosetting property may be used, for example. The electromagnetic pipe expanding inductor 1 comes to have a predetermined outside diameter by cutting the outer periphery surface of the glass cloth 7 after impregnation of the insulating resin. Consequently, in this embodiment, the center-side resin-impregnated layer (glass cloth tape 3) and the shaft portion (bobbin 2) are different in strength characteristics with each other. More specifically, the modulus of longitudinal elasticity of the center-side resin-impregnated layer is lower than that of the shaft portion, and when the modulus of longitudinal elasticity of the shaft portion and that of the center-side resin-impregnated layer are assumed to be E1 and E2, respectively, the ratio E1/E2 is 1.9 or more.

Next, a description will now be given about a method for manufacturing the electromagnetic pipe expanding inductor according to this embodiment. The electromagnetic pipe expanding inductor 1 of this embodiment illustrated in FIG. 1 can be manufactured, for example, by the following method. First, a glass cloth tape 3 is wound around the peripheral surface of the bobbin 2 spirally relative to the axial direction of the bobbin 2. At this time, a part of the width of the glass cloth tape 3 is overlapped on the glass cloth tape 3 which is adjacent in the axial direction of the bobbin 2. In this embodiment, a half or smaller, or half or larger, for example, of the width of the glass cloth tape 3 is overlapped (half-lapped) on the adjacent and already wound glass cloth tape 3. By winding the glass cloth tape 3 while thus half-lapping, dislocation of the tape, unbalanced thickness of the insulating layer, and the like are suppressed. If the overlapping range of the glass cloth tape 3 is made half or less of the tape width, the glass cloth tape 3 is substantially double-wound, while if it is made half or larger of its width, the glass cloth tape 3 is triple-wound or more. By thus adjusting the number of turns of the glass cloth tape 3, the tape thickness of the glass cloth tape 3 is adjusted to a predetermined thickness.

As the method for coating the glass cloth tape 3 around the peripheral surface of the bobbin 2, another method may be adopted. According to another method, a glass cloth tape of such a large width as covers the whole in the axial direction of the to-be-coated portion of the bobbin 2 is used, and then the wide glass cloth tape is wound once around the bobbin 2. Further, a stretchable glass cloth tube may be fitted on the bobbin 2.

Next, a conductor strand 4 coated with a glass cloth tape 6 is wound spirally around the outer periphery of the glass cloth tape 3 to constitute a coil. At this time, the winding is performed in such a manner that confronting surfaces of adjacent conductor strand 4 become parallel to each other.

Then, a glass cloth 7 is wound around the outer periphery of the coil and is thereafter impregnated with resin 8. As the resin 8, an epoxy resin having insulating property and thermosetting property is used, for example. Subsequently, the resin 8 is hardened by heating, whereby the insulating layer is fixed firmly. Then, the outer peripheral surface of the glass cloth 7 is cut with the bobbin 2 as a central shaft, and thereby an electromagnetic pipe expanding coil 1 having a predetermined outside diameter is obtained.

The following description is now provided about the operation of this embodiment. For example, in the case where the electromagnetic pipe expanding coil 1 of this embodiment shown in FIG. 1 is to be used for expanding a metallic pipe, first the shaft portion of the illustrated electromagnetic pipe expanding coil 1 is inserted into the metallic pipe (not shown) as a workpiece. Next, a large shock current is passed through the coil constituted by the conductor strand 4 to create a magnetic field around the shaft portion of the electromagnetic pipe expanding coil 1. As a result, the metallic pipe undergoes a strong outward expanding force under the action of a repulsive force of the electromagnetic field and is pushed against a forming die (not shown) disposed outside the metallic pipe, whereby it is formed into a desired shape. Refrigerant flows through the hollow portion of the conductor strand 4 to cool the heat generated in the conductor strand 4 during the formation.

In this embodiment, the impregnated insulating resin penetrates the glass cloth tape 3 located on the central axis side with respect to the glass cloth tape 6 which covers the conductor strand 4. Therefore, the insulating resin can be penetrated sufficiently even into a boundary portion between adjacent glass cloth tape portions 6, the boundary portion being located on the bobbin 2 side shown as portion A in FIG. 1. Consequently, it is possible to minimize the formation of voids in the interior of the insulating layer.

In this embodiment, as described above, since the formation of voids in the interior of the impregnated resin is minimized, the peripheries of the conductor are firmly fixed. In other words, cracks starting from voids become difficult to be formed in the interior of the insulating layer. As noted above, a large current is supplied to the electromagnetic pipe expanding coil 1 when the coil is in use, but the fear of damaging the electromagnetic expanding coil is minimized for the above reason even in the repeated use, if this embodiment is applied. As a result, the life of the electromagnetic pipe expanding coil can be made extremely long.

Figure 3:
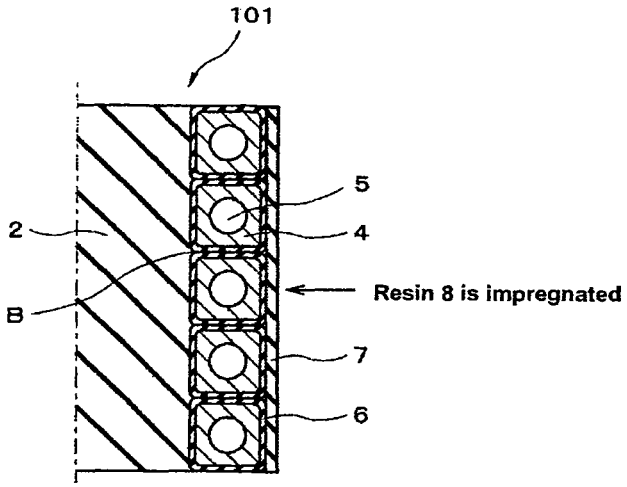
FIG. 3 PRIOR ART
FIG. 3 is a sectional view showing a conventional electromagnetic pipe-expanding inductor.
Figure 4:
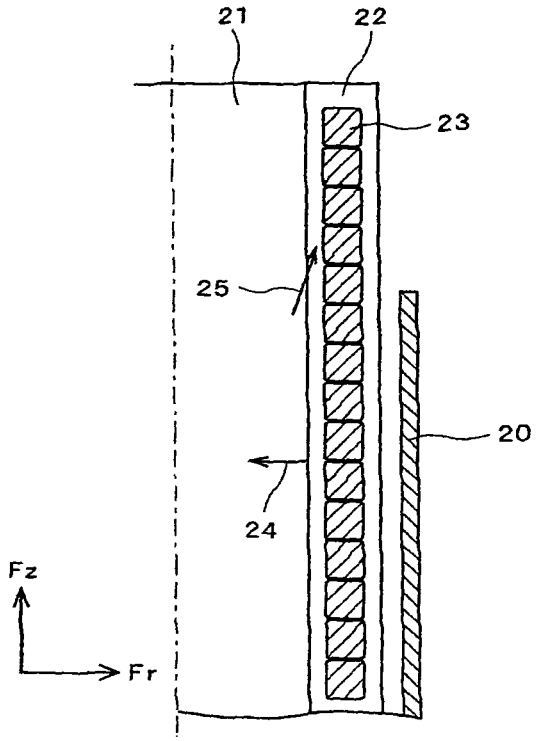
FIG. 4 is a schematic diagram showing stresses developed in electromagnetic forming.

Now, in connection with the electromagnetic pipe expanding inductor of the conventional structure not having the center-side resin-impregnated layer (glass cloth tape 3), which is shown in FIG. 3, a description will be given about a relation between a shear stress and a formable life. When electric power was supplied to the electromagnetic pipe expanding inductor of the conventional structure, a shear stress, $\tau rz$, induced at the interface between the shaft portion (bobbin 2) and the coating impregnated layer (glass cloth tape 6) on the periphery of the conductor, was determined by numerical analysis in accordance with the finite element method.

Figure 5:
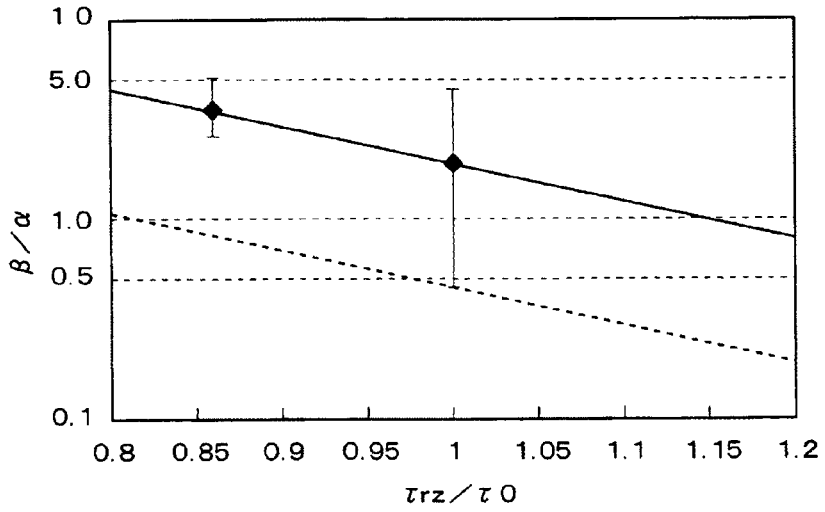
FIG. 5 is a diagram showing a relation between a shear stress ratio and a formable life ratio in connection with an electromagnetic pipe expanding inductor of a conventional structure.

In FIG. 5, in connection with the electromagnetic pipe expanding inductor of the conventional structure, a shear stress ratio $\tau rz/\tau 0$ is plotted along the axis of abscissas, while a logarithmic value of a formable life ratio $\beta/\alpha$ is plotted along the axis of ordinate. FIG. 5 is a graph showing a relation of the two. The $\tau 0$ is a shear stress induced at the interface between the shaft portion and the coating impregnated layer on the periphery of the conductor upon supply of electric power in the conventional electromagnetic pipe expanding inductor. The β and α each represent a formable life when the conventional electromagnetic pipe expanding inductor is used under usual working conditions. Particularly, the β represents a formable life as a reference value capable of ensuring the profitability of the electromagnetic pipe expanding inductor. In the electromagnetic pipe expanding inductor, a crack is developed from a void formed at the boundary between glass cloth tape and is expanded by conductor vibration in the inductor during the supply of electric power, thus causing deformation and breakage. In the fatigue fracture resulting from a repeated load described above, there exists a relation of the following numerical expression 1 between a stress amplitude S and the number of times N which a stress is applied (corresponding to the number of times which electric power is supplied in the inductor), with K being a constant. The stress amplitude S is proportional to the shear stress τ and the stress application time N is proportional to the formable life β. Therefore, when the shear stress value τ0 in the conventional electromagnetic pipe expanding inductor is assumed to be a reference value, the shear stress ratio τrz/τ0 of the shear stress value τrz to the reference value τ0, the shear stress value τrz being created between the shaft portion and the coating impregnated layer on the conductor periphery, is proportional to a logarithm of the ratio β/α of the formable life β to the formable life α as a reference value capable of ensuring the profitability. A solid line in FIG. 5 represents a relation between a mean value of the formable life ratio β/α and the shear stress ratio τrz/τ0. A broken line in the same figure is a straight line extended at the same slope as the solid line and starting from a minimum point (β=0.45α) among variations of the formable life β at a shear stress ratio τrz/τ0 of 1.

$$S=K\log N \tag{1}$$

As shown in FIG. 5, the electromagnetic pipe expanding inductor is large in variations of life due to voids formed in its interior. Among conventional electromagnetic pipe expanding inductors (τrz/τ0=1) there is found even one whose formable life is 0.45 times as long as the life which ensures the profitability. However, if the life of the electromagnetic pipe expanding inductor is short, the machining cost increases and therefore it is extremely important to increase the formable life up to the life which ensures the profitability. As shown in FIG. 5, by decreasing the shear stress τrz, it is possible to prolong the formable life β, and also in the conventional electromagnetic pipe expanding inductor having a minimum formable life β β=0.45α), if the shear stress ratio τrz/τ0 is decreased 19% (τrz/τ0=0.81), it is possible to prolong the formable life β up to the value (β/α=1) which ensures the profitability. More specifically, the ratio τrz/τ0 can be decreased by making small the value of inductor radius, power supply voltage, or the capacitance of capacitor.

Next, a description will be given about the results of numerical analysis of a shear force conducted by a finite element method in connection with the electromagnetic pipe expanding inductor of this embodiment. Numerical analysis was made by a finite element method using, as parameter, the ratio t/r of the thickness, t, of the center-side resin-impregnated layer constituted by the resin-impregnated glass cloth tape 3 to the radius, r, of the electromagnetic pipe expanding inductor to determine a shear stress τrz which was induced at the interface between the shaft portion (bobbin 2) and the center-side resin-impregnated layer (glass cloth tape) during the supply of electric power. In this numerical analysis based on the finite element method, in order to demonstrate that an inductor having excellent characteristics is obtained because of the center-side resin-impregnated layer having strength characteristics different from that of the shaft portion, the module of longitudinal elasticity of the constituent elements were set at 30 GPa for the shaft portion, 16 GPa for the center-side resin-impregnated layer, and 118 GPa for the conductor (conductor strand 4), respectively.

Figure 2:
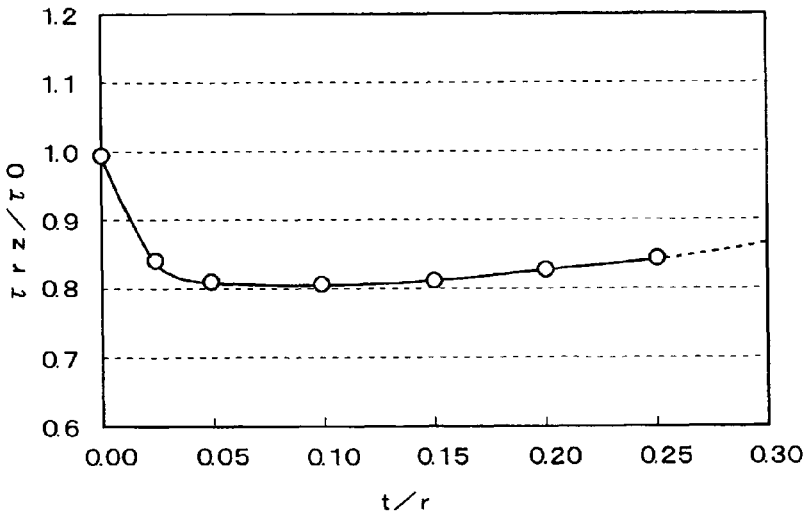
FIG. 2 is a graph showing a state of a shear force, $\tau rz$, decreasing with an increase in thickness, t, of a center-side resin-impregnated layer in an embodiment of the present invention.

FIG. 2 is a graph showing a relation between τrz/τ0 and t/r, the former being plotted along the axis of ordinate and the latter plotted along the axis abscissas. The τ0 represents a shear stress in the absence of the center-side resin-impregnated layer (t=0, see FIG. 3). As shown in FIG. 2, as the thickness, t, of the center-side resin-impregnated layer increases, the shear stress τrz decreases, and when t/r is 0.1, the shear stress τrz takes a minimum value, about 20% drop in comparison with the case of t=0. In the present invention it is judged that the shear stress decreasing effect based on the provision of the center-side resin-impregnated layer is exhibited when the degree of lowering of the shear stress is 15% or more of .quadrature.0. In the present invention, it is preferable that the t/r ratio be set at a value in the range from 0.025 to 0.25 from the above standard. Accordingly, when the radius, r, of the electromagnetic pipe expanding inductor is 20 mm, a preferable thickness range of the center-side resin-impregnated layer is from 0.5 to 5 mm.

The thickness of the center-side resin-impregnated layer depends on the kind, thickness and the number of turns of the glass cloth tape 3. It is presumed that the commercially available glass cloth tapes generally range from about 0.05 to 0.30 mm in thickness. When the glass cloth tape 3 is wound around the bobbin in a half-lap fashion (50% of the width is overlapped), if the thickness of the glass cloth tape is 0.3 mm, the thickness, t, of the fiber layer serving as the center-side resin-impregnated layer becomes about 0.6 mm, which is twice as large as the thickness of the glass cloth tape. This value falls under the preferable thickness range (0.5 to 5 mm) of the center-side resin-impregnated layer. In case of the glass cloth tape being smaller in thickness, a glass cloth tape is wound while half-lapped on a layer of a half-lapped glass cloth tape, and thereby the foregoing preferable thickness range of the center-side resin-impregnated layer is attained. On the other hand, if 50% or more of the width of the glass cloth tape is overlapped, the thickness, t, of the fiber layer serving as the center-side resin-impregnated layer becomes three times or more as large as the thickness of the glass cloth tape. In the case where the glass cloth tape thickness is 0.30 mm and the lapped portion is three times in thickness, the thickness, t, of the fiber layer becomes about 0.9 mm. Accordingly, by half-lapping the glass cloth tape, the thickness, t, of the center-side resin-impregnated layer is set between the preferred range, i.e., from 0.5 to 5 mm. Thus, it is preferable to select the thickness, t, of the center-side resin-impregnated layer in such a manner that t/r is preferably in the range of 0.025 to 0.25, more preferably 0.10.

Since the center-side resin-impregnated layer has strength characteristics different from that of the shaft portion, the center-side resin-impregnated layer functions as a so-called buffer material. Controlling the thickness, t, of the center-side resin-impregnated layer to keep a t/r value in the range of 0.025 to 0.25 also enhances the action as a buffer material. In case of the center-side resin-impregnated layer playing a buffer-like role, it is possible to suppress breakage of the electromagnetic pipe expanding inductor and improve the durability thereof. For the center-side resin-impregnated layer to fulfill its function as a buffer material, it is preferable that the center-side resin-impregnated layer be lower in the modulus of longitudinal elasticity than the shaft portion. More specifically, given that the modulus of longitudinal elasticity of the shaft portion and that of the center-side resin-impregnated layer are E1 and E2, respectively, the E1 to E2 ratio, E1/E2, is 1.9 or more.

FIG. 2 shows the results of numerical analysis made in accordance with a finite element method. More specifically, there was determined a shear stress □rz which was induced at the interface between the shaft portion (bobbin 2) and the center-side resin-impregnated layer (glass cloth tape 3) during the supply of electric power, and a check was made about the effect of the center-side resin-impregnated layer serving as a buffer material. Also as to a shear stress induced at the interface between the center-side resin-impregnated layer (glass cloth tape 3) and the glass cloth 6 which covers the coil conductor 4, numerical analysis was made by the finite element method. As a result, the shear stress was found to be decreased also at this interface.

Thus, by a synergistic effect of both the decrease of the shear stress acting on the interface between the shaft portion (bobbin 2) and the center-side resin-impregnated layer constituted by the resin-impregnated glass cloth tape 3 and the decrease of the shear stress acting on the portion A in FIG. 1 (the interface between the center-side resin-impregnated layer (glass cloth tape 3) and the glass cloth 6 which covers the coil conductor 4), it is possible to prolong the life of the electromagnetic pipe expanding inductor 1 to a remarkable extent. According to the present invention, moreover, since a fiber layer serving as the center-side resin-impregnated layer is provided between the shaft portion and the coil, the incoming path of the insulating resin in the impregnating process becomes larger than in the conventional counterpart, thereby suppressing the formation of voids, with the result that the starting points of peeling in repeated application of an electromagnetic reaction force diminish and it is possible to improve the durability remarkably. This also leads to a prolonged life of the electromagnetic pipe expanding inductor.

Next, with the modulus of longitudinal elasticity, E1, of the shaft portion (bobbin 2) as a parameter, numerical analysis was made by the finite element method to determine a shear stress □rz which was induced at the interface between the shaft portion (bobbin 2) and the center-side resin-impregnated layer (glass cloth tape 3) during the supply of electric power. In this numerical analysis by the finite element method, the modulus of longitudinal elasticity of the center-side resin-impregnated layer and that of the conductor (conductor strand 4) were set at 16 GPa and 118 GPa, respectively. The ratio t/r of the thickness, t, of the center-side resin-impregnated layer to the radius, r, of the electromagnetic pipe expanding inductor was set at 0.10 corresponding to the minimum value of the shear stress ratio □rz/□0.

Figure 6:
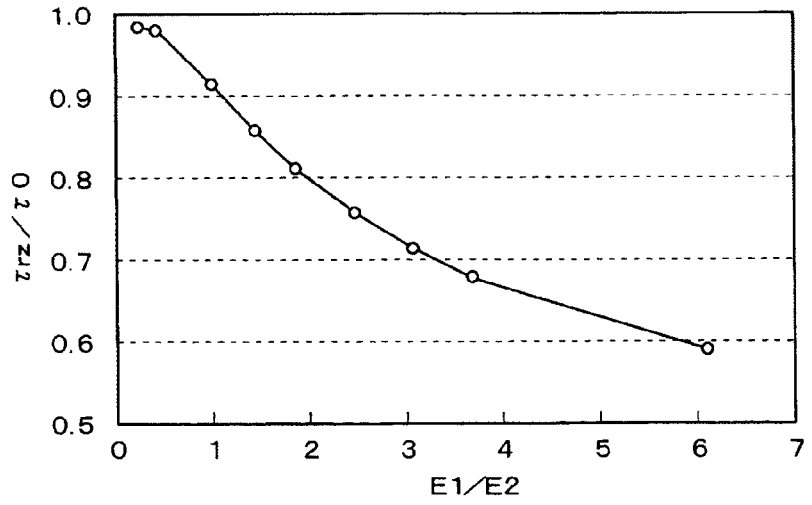
FIG. 6 is a diagram showing a relation between a longitudinal elasticity modulus ratio and a shear stress ratio in an embodiment of the present invention.

FIG. 6 shows a relation between the longitudinal elasticity modulus ratio E1/E2 and the shear stress ratio □rz/r0. E2 stands for the modulus of longitudinal elasticity of the center-side resin-impregnated layer. As shown in FIG. 6, as the modulus of longitudinal elasticity, E1, of the shaft portion increases, the shear stress □rz decreases. From FIG. 5, it can be seen that if the shear stress ratio □rz/□0 is made smaller 19% or more than that in the related art, the life of the electromagnetic pipe expanding inductor is prolonged as a result of decrease of the shear stress, exhibiting the effect of provision of the center-side resin-impregnated layer. Thus, in view of FIG. 6, it is preferable that the ratio E1/E2 of the modulus of longitudinal elasticity, E1, of the shaft portion to the modulus of longitudinal elasticity, E2, of the center-side resin-impregnated layer be 1.9 or higher. For example, when the modulus of longitudinal elasticity, E2, of the center-side resin-impregnated layer is 16 GPa, the modulus of longitudinal elasticity, E1, of the shaft portion may be 30 GPa or higher. More particularly, in case of using GFRP having a modulus of longitudinal elasticity of about 60 GPa (see Non-Patent Literature 1, Fukugo Zairyo Handobukku, published by Nikkan Kogyo Shimbun, Ltd., edited by Japan Society for Composite Materials, 1989) as the shaft portion, since the value of E1/E2 is 3.75, from FIG. 6 it is seen that the shear stress can be decreased 32% and that the life of the electromagnetic pipe expanding inductor can be prolonged remarkably.

Next, with the radius, r, of the electromagnetic pipe expanding inductor as a parameter, numerical analysis based on the finite element method was performed to determine a shear stress □rz induced at the interface between the shaft portion (bobbin 2) and the center-side resin-impregnated layer (glass cloth tape 3) with respect to each of the case where the modulus of longitudinal elasticity, E1, of the shaft portion was 16 GPa and the case where it was 30 GPa. In both cases the modulus of longitudinal elasticity, E2, of the center-side resin-impregnated layer was assumed to be 16 GPa. Further, the ratio t/r of the thickness, t, of the center-side resin-impregnated layer to the radius, r, of the electromagnetic pipe expanding inductor was set at 0.10 corresponding to a minimum value of the shear stress ratio □rz/□0.

Figure 7:
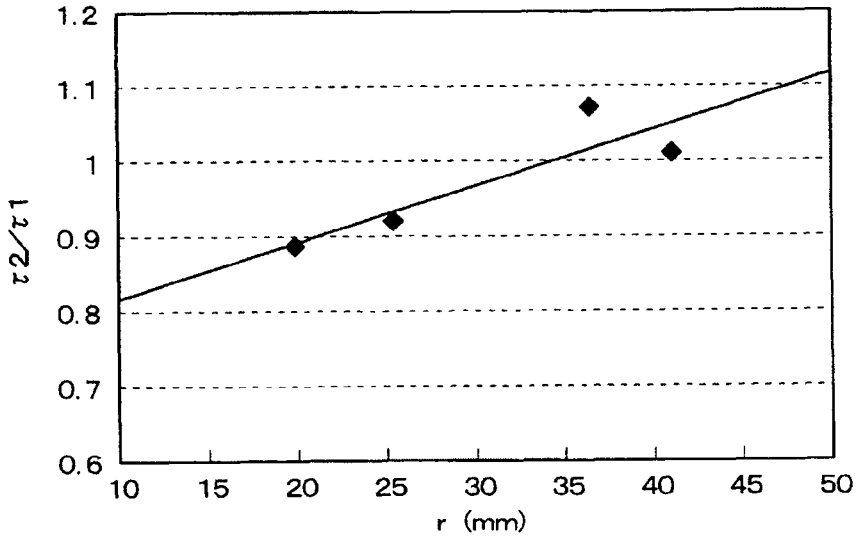
FIG. 7 is a diagram showing a relation between the radius of the electromagnetic pipe expanding inductor and a shear stress ratio in an embodiment of the present invention.

FIG. 7 shows a relation between a shear stress ratio □2/□1 and the radius, r, of the electromagnetic pipe expanding inductor. The □1 stands for a shear stress □rz which is induced at the interface between the shaft portion and the center-side resin-impregnated layer when the modulus of longitudinal elasticity, E1, of the shaft portion is 16 GPa, while □2 stands for a shear stress □rz which is induced at the interface between the shaft portion and the center-side resin-impregnated layer when the modulus of longitudinal elasticity, E1, of the shaft portion is 30 GPa. The longitudinal elasticity modulus E1/E2 is constant. As shown in FIG. 7, the smaller the radius, r, of the electromagnetic pipe expanding inductor, the lower the shear stress ratio □2/□1, and the shear stress ratio □2/□1 becomes 1 or lower when the radius, r, of the electromagnetic pipe expanding inductor is 35 mm or smaller. That is, for attaining a shear stress reducing effect by making the modulus of longitudinal elasticity, E1, of the shaft portion large, it is preferable that the radius, r, of the electromagnetic pipe expanding inductor be 35 mm or smaller.

In this embodiment, insulating resin is used as the material of the bobbin 2. As characteristics required for the material of the bobbin 2, there are, for example, high insulating property, high strength, high cutting workability, and affinity for the outer surface impregnating resin. According to this embodiment, since the entire peripheral surface of conductor is impregnated with resin, which is firmly fixed, it is possible to select any of various materials as the resin used for the bobbin 2. For example, in this embodiment, since the integrity between he conductor strand 4 and the surrounding impregnated layers (glass cloth tape 3, glass cloth tape 6, glass cloth 7 and resin) is high, the bobbin may be formed of a material somewhat low in its affinity for the outer surface impregnated resin layer (glass cloth 7). Thus, a low cost material is employable for the bobbin 2.

Although the conductor strand 4 has a rectangular section in this embodiment, the present invention is not limited to this embodiment. As shown in FIG. 1, the present invention is suitable for a conductor strand of a rectangular section which a slight void is apt to be formed between two adjacent rows of conductor strand 4 and the bobbin 2 side, but the invention is effectively applicable even to a conductor strand of for example a circular section, because the impregnatability of the conductor strand where it is contacted with the bobbin side is improved by the fiber layer serving as the center-side resin-impregnated layer and hence it is possible to attain a high integrity.

What is claimed is:

1. An electromagnetic pipe expanding inductor comprising:

a shaft portion;

a center-side resin-impregnated layer different in strength characteristics from said shaft portion, said center-side resin-impregnated layer being formed by impregnating insulating resin into a resin-impregnatable fiber layer coated on a periphery of said shaft portion and then hardening said insulating resin, wherein said center-side resin-impregnated layer is wound spirally at least partly overlapping to a predetermined thickness, the predetermined thickness being based on a number of turns of the center-side resin-impregnated layer;

a coil formed by winding a conductor around a peripheral surface of said center-side resin-impregnated layer, said conductor being completely coated with a resin-impregnatable fiber layer impregnated with insulating resin, said insulating resin being hardened after the impregnation, wherein the conductor has a hollow portion defined therein for circulating refrigerant therethrough; and an outer resin-impregnated layer formed by impregnating a resin-impregnatable fiber layer coated on an outer periphery of said coil with insulating resin and hardening said insulating resin;

wherein a radius of the electromagnetic pipe expanding inductor is 35 mm or smaller, and when a modulus of longitudinal elasticity of said shaft portion and that of said center-side resin-impregnated layer are E1 and E2, respectively, said shaft portion is formed of a material having an E1/E2 ratio of 1.9 or more.

2. The electromagnetic pipe expanding inductor according to claim 1, wherein said resin-impregnatable fiber layers are each constituted by a glass cloth tape.

3. The electromagnetic pipe expanding inductor according to claim 1, wherein said resin-impregnatable fiber layer which constitutes said center-side resin-impregnated layer is constituted by said glass cloth tape wound once or more around said shaft portion, and the ratio t/r of the thickness, t, of said center-side resin-impregnated layer to the radius, r, of the whole of the inductor is in the range from 0.025 to 0.25.

4. The electromagnetic pipe expanding inductor according to claim 1, wherein said center-side resin-impregnated layer has a modulus of longitudinal elasticity lower than that of said shaft portion.

5. The electromagnetic pipe expanding inductor according to claim 2, wherein said center-side resin-impregnated layer has a modulus of longitudinal elasticity lower than that of said shaft portion.

6. The electromagnetic pipe expanding inductor according to claim 3, wherein said center-side resin-impregnated layer has a modulus of longitudinal elasticity lower than that of said shaft portion.

* * * * *